United States Patent [19]

Satoh et al.

[11] 4,131,458

[45] Dec. 26, 1978

[54] ELECTRICAL CONTACT MATERIAL OF SILVER BASE ALLOY

[75] Inventors: Mitsunori Satoh, Yokohama; Masayuki Hijikata, Tokyo; Hiroshi Maeda, Funabashi; Ichiro Morimoto, Tokyo, all of Japan

[73] Assignee: National Research Institute for Metals, Tokyo, Japan

[21] Appl. No.: 843,281

[22] Filed: Oct. 18, 1977

[30] Foreign Application Priority Data

Oct. 21, 1976 [JP] Japan ..... 51/125451

[51] Int. Cl.[2] ..... C22C 5/06

[52] U.S. Cl. ..... 75/173 R; 75/951; 200/266

[58] Field of Search ..... 75/173 R, 951; 200/266

[56] References Cited

U.S. PATENT DOCUMENTS 3,705,796 12/1972 Takahashi ..... 75/173 R
3,970,451 7/1976 Davies ..... 75/173 R

FOREIGN PATENT DOCUMENTS 1,270,199 4/1972 United Kingdom ..... 75/173 R

*Primary Examiner*—M. J. Andrews
*Attorney, Agent, or Firm*—Sherman & Shalloway

[57] ABSTRACT

An electrical contact material consisting essentially of silver and a small amount of zinc oxide, tellurium oxide, and optionally indium oxide and tin oxide, these oxides being uniformly dispersed in the silver matrix.

2 Claims, 6 Drawing Figures

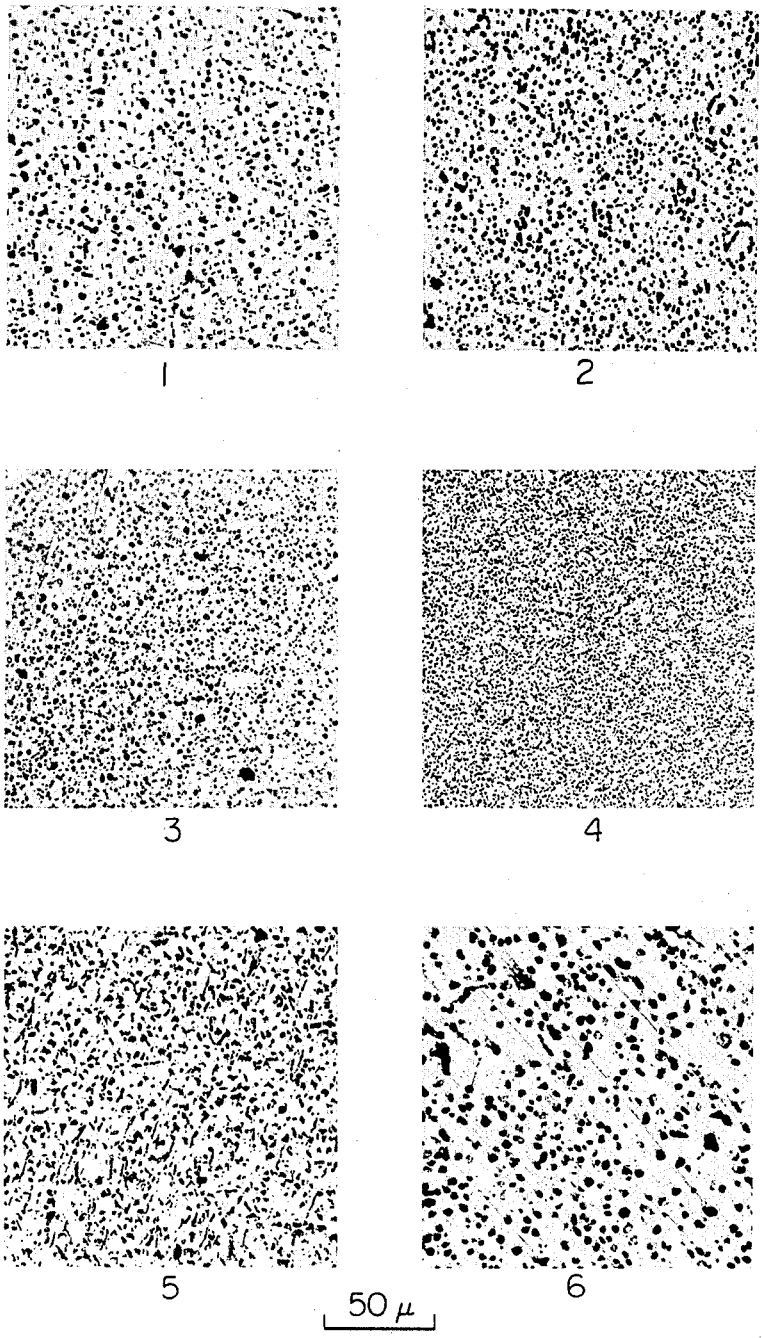
1
2
3
4
5
6
50 μ

ELECTRICAL CONTACT MATERIAL OF SILVER BASE ALLOY

This invention relates to an electrical contact material comprising silver and small amounts of specified metal oxides uniformly dispersed in the metal matrix, and to a process for producing the electrical contact material.

Silver and silver base alloys such as Ag-Pd, Ag-Au, Ag-Ni, Ag-W, Ag-Mo, Ag-C and Ag-Cd alloys have been widely used as a contact material for electromagnetic switches. Particularly, an Ag-CdO alloys containing about 12% by weight of cadmium oxide (Ag-12CdO) has been used as a contact material having the best properties. In recent years, however, the use of cadmium has been blamed for its adverse effects on the human body and for environmental pollution. Contact materials free from cadmium have therefore been strongly desired.

It is an object of this invention to provide a silver base alloy contact material free from harmful cadmium and having properties comparable or superior to those of the Ag-CdO contact material.

A contact material composed of silver and a metal oxide, such as Ag-CdO, can be obtained by heating an alloy of silver and the metal to a specified temperature in an oxidizing atmosphere to oxidize the metal selectively. This treatment is called internal oxidation. Recently, an Ag-ZnO alloy has aroused interest in the technical field of contact material as a replacement for the Ag-CdO alloy because the physical and chemical properties of Zn are similar to those of Cd. However, when a binary alloy material of Ag-Zn is subjected to internal oxidation, zinc oxide grows in the form of needles. Especially when the amount of Zn in the alloy exceeds 5 atomic %, a layer of zinc oxide is formed on the surface of the material, and the selective oxidation of zinc still present in the internal layer does not proceed. Consequently, the resulting contact material is not feasible because its poor resistances to welding adhesion and to erosion.

The present inventors have found, as a result of investigations to remove the defects of the Ag-ZnO contact material, that the above defect can be eliminated by dispersing a small amount of tellurium oxide in the above material, and a superior contact material can be obtained.

It was further found that the properties of the contact material can be further improved by dispersing a small amount of either one or both of indium oxide and tin oxide as an additional component in the material.

The electrical contact material of this invention consists essentially of silver and uniformly dispersed in the silver (a) 1 to 12 atomic % of zinc oxide, (b) 0.1 to 1 atomic % of tellurium oxide, and (c) as an optional ingredient, at least one of indium in an amount of 0.3 to 8 atomic % and tin oxide in an amount of 0.3 to 3 atomic %, the total amount of (a) + (b) or (a) + (b) + (c) being in the range of 2 to 13 atomic %, and all amounts being calculated as metal.

The electrical contact material of this invention is produced by melting an alloy consisting essentially of silver and metals convertible to the above metal oxides so that the metals dissolve uniformly in the silver, and heating the resulting composition at a temperature of about 700° C. to about 880° C. in an oxidizing atmosphere until the metals are turned into their oxides.

When specified amounts of the metals are added to silver and the mixture is heated to a temperature above 960° C. which is the melting point of silver, the metal ingredients added readily disperse uniformly in the silver matrix. The resulting alloy composition is solidified by cooling, and then heated to a predetermined temperature in an oxidizing atmosphere to oxidize the dispersed metal ingredients selectively. Preferably, prior to the selective oxidation step, the alloy composition is worked into the actual shape of a contact piece to be used, for example a thin flattened cylinder, a square pillar, a plate, or into a shape which can be easily cut to final products such as a thin plate. This is because after the added metal ingredients have been converted to their oxides, the mechanical working of the resulting material into contact materials rather becomes difficult.

The oxidizing atmosphere may be oxygen or an oxygen-containing gas such as air. At a temperature of at least about 400° C., the added metal ingredients undergo selective oxidation. Since at lower temperatures, for example, at temperatures lower than about 300° C., silver is also oxidized, such lower temperatures should not be employed. On the other hand, the heating temperature should, of course, be not so high as to melt silver. The most preferred temperature is about 700° to about 880° C. The rate of selective oxidation increases with higher heating temperatures, and so does the particle diameter of the resulting metal oxides. When the intended final contact piece is of small-sized, the particle size of the metal oxides is preferably small. However, when large-sized final products are desired, the particle size of the oxides may be large, and at times, it is preferably so.

The time required to oxidize the added metal ingredients completely varies according to the types and amounts of the added metal ingredients, the temperature used and the thickness of the contact piece. Generally, the time is about 200 hours at a temperature of about 800° C. The required time can be ascertained for each case by a preliminary experiment.

Only when the contents of the metal oxides in the electrical contact material of this invention are within the specified ranges described hereinabove, especially superior results can be obtained. The reasons are given below. In the following, all atomic percentages are calculated as metal.

When an Ag-Zn alloy having a Zn content of less than 1 atomic % is subjected to the selective oxidation treatment, it cannot fully provide good characteristics as a contact material. If, on the other hand, the Zn content exceeds 12 atomic %, zinc oxide precipitates in a layer as a result of the selective oxidation. If such a structure results, the electric and heat conductivities of the material decrease markedly. Consequently, the electrical contact resistance of the material increases, and its resistance to welding adhesion and to erosion are deteriorated markedly, thus making it impossible to meet the characteristics required of electrical contact material. However, when 0.1 to 1 atomic % of Te is added, zinc oxide does not precipitate in the crystalline grain boundary at the time of selective oxidation, but are uniformly and finely dispersed in the silver matrix. In addition, the allowable content of zinc oxide to be uniformly dispsersed can be increased to as high as 12 atomic %.

The particle size of the resulting metal oxides can be controlled by changing the amounts of the metals within the above-specified ranges. The oxides of the added metals exhibit marked effects in improving the characteristics of contact material. If the amount of Te exceeds 1 atomic %, the processability of the alloy decreases.

A better contact material can be obtained by optionally adding 0.3 to 8 atomic % of In and/or 0.3 to 3 atomic % of Sn to the alloy and then subjecting the composition to the selective oxidation. When indium oxide and/or tin oxide is included, the hardness of the contact material further increases. Such a contact material has a high resistance to welding adhesion and to erosion, and particularly, has superior characteristics as a high load contact material. When both indium oxide and tin oxide are present together, the resulting high-load contact material has an increased resistance to erosion. If the amount of indium exceeds 8 atomic % or the amount of Sn exceeds 3 atomic %, the oxide precipitated at the time of selective oxidation becomes a layer. Hence, amounts outside the specified ranges should be avoided.

It is important that the total amounts of these metal oxides in the contact material of this invention should be 2 to 13 atomic %. If the total amount is lower than 2 atomic %, it is impossible to obtain a contact material having sufficiently satisfactory characteristics. On the other hand, when it exceeds 13 atomic %, the metal oxides precipitate in layers at the time of the selective oxidation, and characteristics required of contact material cannot be obtained.

The electrical contact material of this invention does not at all contain a toxic cadmium component, and consists of silver and oxides of other metal ingredients which are easily available at relatively low costs. In addition, the characteristics of the electrical contact material are comparable or superior to those of an Ag-CdO contact material which is a typical conventional contact material.

The following Examples further illustrate the characteristics of the present invention.

Microphotographs showing the internal structures of contact material samples obtained in these examples are attached to this application. The numbers of these photographs correspond to the numbers of Examples. In these photographs, black spots show metal oxides, and the matrix shows silver. It can be seen from these photographs that in the samples in accordance with this invention, the metal oxides are finely and uniformly dispersed in the silver matrix.

EXAMPLE 1

Each of mixtures having the compositions shown in Table 1 was melted in a Tamman furnace, and 600 g of an ingot in which the individual ingredients were uniformly alloyed was produced. The hardness Hv (Vickers hardness) of each of the resulting alloys is given in Table 1.

Table 1

| Sample No. | Composition (atomic %) Zn | Te | Sn | In | Cd | Ag | Hardness (Hv) |
|---|---|---|---|---|---|---|---|
| 1 | 8 | 0.5 | — | — | — | balance | 69.1 |
| 2 | 6 | 0.5 | 1 | — | — | balance | 83.2 |
| 3 | 6 | 0.5 | — | 2 | — | balance | 76.3 |

Table 1-continued

| Sample No. | Composition (atomic %) Zn | Te | Sn | In | Cd | Ag | Hardness (Hv) |
|---|---|---|---|---|---|---|---|
| 4 | 6 | 0.5 | 1 | 1 | — | balance | 87.6 |
| 5 | 4 | 0.5 | 1 | 4 | — | balance | 96.2 |
| 6* | — | — | — | — | 12 | balance | 71.5 |
| Control | — | — | — | — | — | 99.9< | 33.0 |

*Comparison (Ag-Cd alloy)

Pieces having the shape of a testing contact piece (the diameter of the contacting surface 10 mm; the radius of curvature 30 mmR) were produced from each of the ingots by machine working. The pieces were held in the atmosphere at 800° C. for 200 hours to oxidize the metallic ingredients other than silver selectively.

The contacting surfaces of two testing contact pieces of each sample were set so as to face each other, and the characteristics of the sample as a contact material were determined as follows:

Electrical circuit conditions

Alternating current; voltage 200 volts; current 90 amperes; power factor 0.3; the number of cycles of opening and closing $10^5$.

Resistance to erosion

The weights of a sample contact piece before and after testing are measured by a microbalance, and the amount of s consumption (mg) is determined from the difference between these weights.

Resistance of welding adhesion

This is evaluated by the number of welding cycles during the $10^5$ opening-closing tests.

Contact electrical resistance

In the last 10 opening-closing operations of the $10^5$ opening-closing tests, the voltage drop between two contact pieces is measured. The contact electrical resistance (mΩ) is calculated from the voltage drop and the current used for testing.

The results of these tests are shown in Table 2.

Table 2

| Sample No. | Amount of consumption (mg) | Number of welding cycles | Contact electrical resistance (mΩ) |
|---|---|---|---|
| 1 | 91 | 49 | 0.1 - 0.5 |
| 2 | 84 | 37 | 0.1 - 0.5 |
| 3 | 75 | 46 | 0.1 - 0.6 |
| 4 | 72 | 35 | 0.1 - 0.5 |
| 5 | 69 | 41 | 0.1 - 0.7 |
| 6* | 76 | 38 | 0.1 - 0.5 |
| Control | 267 | 350 | 0.1 - 0.5 |

It can be seen from Table 2 that the contact material of this invention has far superior characteristics to an Ag contact material, and is equivalent, or superior, to an Ag-CdO contact material containing a toxic cadmium ingredient.

What we claim is:

1. An electrical contact material consisting essentially of silver and uniformly dispersed in the silver,
   (a) 1 to 12 atomic % of zinc oxide and
   (b) 0.1 to 1 atomic % of tellurium oxide, the total amount of (a) and (b) being 2 to 13 atomic %, and all amounts being calculated as metal.

2. An electrical contact material consisting essentially of silver and uniformly dispersed in the silver,
   (a) 1 to 12 atomic % of zinc oxide,
   (b) 0.1 to 1 atomic % of tellurium oxide, and
   (c) at least one of 0.3 to 8 atomic % of indium oxide and 0.3 to 3 atomic % of tin oxide, the total amount of (a), (b) and (c) being 2 to 12 atomic %, and all amounts being calculated as metal.

* * * * *